US007543708B2

(12) United States Patent
Doyle et al.

(10) Patent No.: US 7,543,708 B2
(45) Date of Patent: Jun. 9, 2009

(54) PLASTIC BAG FOR FINE POWDERS

(75) Inventors: Stanley B. Doyle, Port Clinton, OH (US); George W. Boggia, Crown Point, IN (US); Salvatore C. Immordino, Jr., Trevor, WI (US)

(73) Assignee: United States Gypsum Company, Chicago, IL (US)

( * ) Notice: Subject to any disclaimer, the term of this patent is extended or adjusted under 35 U.S.C. 154(b) by 148 days.

(21) Appl. No.: 10/924,314

(22) Filed: Aug. 23, 2004

(65) Prior Publication Data

US 2006/0037884 A1 Feb. 23, 2006

(51) Int. Cl.
*B65D 81/20* (2006.01)
*B65B 31/00* (2006.01)
*B65D 33/01* (2006.01)

(52) U.S. Cl. ..... 206/524.8; 53/404; 53/434; 383/100

(58) Field of Classification Search ..... 206/524.8, 206/484, 528, 0.5; 383/100–103; 53/434, 53/404, 405, 436; 156/94, 275.5
See application file for complete search history.

(56) References Cited

U.S. PATENT DOCUMENTS

| | | | | |
|---|---|---|---|---|
| 3,229,813 | A * | 1/1966 | Crowe, Jr. et al. | 383/102 |
| 4,310,118 | A * | 1/1982 | Kisida et al. | 383/102 |
| 4,550,546 | A | 11/1985 | Raley et al. | |
| 4,672,684 | A | 6/1987 | Barnes et al. | |
| 4,743,123 | A | 5/1988 | Legters et al. | |
| 5,164,178 | A * | 11/1992 | Muysson | 206/484 |
| 5,492,705 | A | 2/1996 | Porchia et al. | |
| 5,584,409 | A * | 12/1996 | Chemberlen | 383/103 |
| 5,624,332 | A * | 4/1997 | Dalton et al. | 156/273.3 |
| 6,120,817 | A | 9/2000 | Archibald et al. | |
| 6,126,975 | A | 10/2000 | Archibald et al. | |
| 6,132,780 | A | 10/2000 | Archibald et al. | |
| 6,441,340 | B1 * | 8/2002 | Varriano-Marston | 219/121.7 |
| 2004/0265447 | A1 * | 12/2004 | Raniwala | 426/397 |

FOREIGN PATENT DOCUMENTS

JP 09188361 A * 7/1997

OTHER PUBLICATIONS

Patent Abstracts of Japan, English Abstract of JP 09-188361 A.*
Computer Translation of JP 09-188361 A. Translated to English on Sep. 1, 2006.*

* cited by examiner

*Primary Examiner*—J. Gregory Pickett
(74) *Attorney, Agent, or Firm*—Pradip Sahu, Esq.; David F. Janci, Esq.; Greer, Burns & Crain, Ltd.

(57) ABSTRACT

A method of making and filling a plastic bag includes the steps of providing a bag having a plurality of microperforations; filling the bag with a powdered product; securing the bag; removing at least a portion of entrapped air in the bag through the microperforations; and sealing the microperforations. A product includes a bag configured for being formed from a plastic film into which a plurality of microperforations have been created. The bag contents include less air than that present in the bag when the top and the bottom were secured, at least a portion of the air sealed inside the bag having been expelled through the microperforations. A sealant is used for sealing the microperforations.

18 Claims, 2 Drawing Sheets

PLASTIC BAG FOR FINE POWDERS

FIELD OF THE INVENTION

This invention relates to the packaging of powdered materials. More specifically, it relates to the forming and filling of plastic bags for use with powdered material.

BACKGROUND

Traditionally, powdered products such as joint compounds, cement, cocoa, flour and the like, have been packaged in paper bags for use with high-speed filling and forming machines. However, there are many drawbacks associated with the use of paper bags. Paper bags are not water-resistant. If exposed to water or to humid conditions, the paper absorbs the water, often transferring it to the contents of the bag. If the contents include cement or gypsum, for example, the introduction of water can allow the material to set, rendering it inactive for later use. Paper bags also lack strength. They are punctured or torn relatively easily, allowing the contents to spill out and be lost.

Attempts have been made to utilize plastic bags for powdered products due to their higher strength and water resistance. When non-porous plastic films are used to keep water out, residual air that is inside the bag at the time it is sealed is trapped inside. Backpressure that is created upon filling causes the bags to acquire balloon-like appearance. In many cases, bags are underfilled due to the product being blown out of the bag during automatic filling. The ballooned bags take up additional space for storage and shipping, can be unstable when stacked, compromise the heat seals and reduce the overall efficiency and cleanliness of the production line. The use of suction to remove the excess air often draws a portion of the product with the removed air.

Processes and equipment have been developed that remove much of the air from a plastic bag prior to sealing, but the current technology is limited to about four bags per minute. This rate is considerably less than the ten bags per minute that can be achieved with paper bags in a conventional Form/Fill/Seal process.

In order to overcome this problem, polyvinylchloride bags have been perforated with needles to provide openings through which the residual air can escape. Even relatively thin needles result in perforations of about 1,000 μm, a size that is relatively large compared to the 10 μm to about 50 μm particle size of fine powders. During packaging and handling, the powders can escape through the perforations, creating a mess and loss of product. Moreover, the needle perforations varied greatly in diameter and had ragged edges, sometimes causing the holes to plug and hinder the escape of residual air.

A plastic foil bag with laser-formed venting perforations is disclosed in U.S. Pat. No. 4,743,123. The foil wall is perforated by laser radiation. The perforations range in size from about 50 μm to about 150 μm. Spacing of the perforations must be chosen to preserve the strength of the foil. Moisture, and at times product, enters and exits the bag through the perforations. Even when two layers of bags are used and the perforations are staggered, air and contaminants have a longer, more tortuous path to follow, but they still can enter the bag.

In U.S. Pat. No. 6,126,975, a bag is disclosed having a flap over the microperforations. In the manner of a petal or check valve, when entrapped air leaves the bag, the flap is blown out of the path, but then the flap settles down over the pores when air is no longer coming from the bag. However, this flap is easily pushed aside by friction against adjoining bags, or can even be torn off. As with the two layer bag, air, moisture and product can still enter and exit the bag.

There is, therefore, a need in the art for a strong bag for powdered materials that can be formed and filled at rates comparable to those of paper bags. Another need exists for a bag that allows residual air in the bag to be expelled at a rapid rate. Yet another need exists for a water resistant bag for fine powders that are degraded by premature exposure to moisture.

SUMMARY OF THE INVENTION

These and other needs are fulfilled by the present process for packaging a powdered material in a plastic bag and a bag from that process. The present process of making and filling a plastic bag includes the steps of providing at least one plastic film; creating a plurality of microperforations in the film; forming a bag from the film; filling the bag with a powdered product; securing the bag; removing at least a portion of the entrapped air in the bag through the microperforations; and sealing the microperforations. In a preferred embodiment of this invention, the microperforations are sealed with a UV-curable resin.

Another aspect of this invention relates to a product including a bag having a bottom, at least one side and a top, the bag configured for being formed from a plastic film into which a plurality of microperforations have been created, the top and bottom being secured; bag contents inside the bag comprising a powered product and an amount of air less than that present in the bag when the top and the bottom were secured, at least a portion of the air sealed inside the bag having been expelled through the microperforations; and a sealant configured for sealing the microperforations. Yet another aspect of this invention is perforating only a portion of the bag.

This product and the associated production process provide a bag for powdered material that is efficiently formed and filled on form/fill/seal equipment. Instead of requiring that the residual air be removed prior to sealing the bag, the securing step can take place immediately after filling since the air is removable after the bag is secured. This results in the ability to use more conventional form/fill/seal equipment and increases the rate of bag filling and sealing.

Air that is sealed within the bag is rapidly expelled through the microperforations, yet the perforations are small enough that only a very minor amount of powdered material escapes from the bag with the air. Easy release of the residual air allows the bags to be made from non-porous components, such as plastics, foils, and other materials that keep air and moisture from entering the bag, preserving the quality of the packaged product. When the air is vented from the bag, it takes up less storage space in containers, delivery vehicles and warehouses, thus reducing transportation and storage costs.

Use of a sealant to close the microperforations also inhibits air, moisture and contaminants from entering the bag. Humid air is prevented from entering the bag to react with calcined gypsum, cement or other hydraulic materials through the microperforations. Sealing of the microperforations also keeps the fine powders inside the bag, delivering to the consumer the full weight to which the bag was filled and reducing the mess of fine powders leaking out when the bags are moved from delivery trucks, to the store shelves, to the consumer's vehicle and finally to a storage or use area.

In a preferred embodiment, a laser is used to cut the holes in the film. The laser actually rotates to burn a small, round, smooth hole in the film. The opening size is tightly controlled and has no jagged edges that may reduce air flow or cause the fine powder to become clogged in the opening. Thus, the use of the laser results in more uniformity and controllability of the microperforations than has been available with mechanical cutting equipment.

DETAILED DESCRIPTION OF THE DRAWINGS

DETAILED DESCRIPTION OF THE INVENTION

Figure 1:
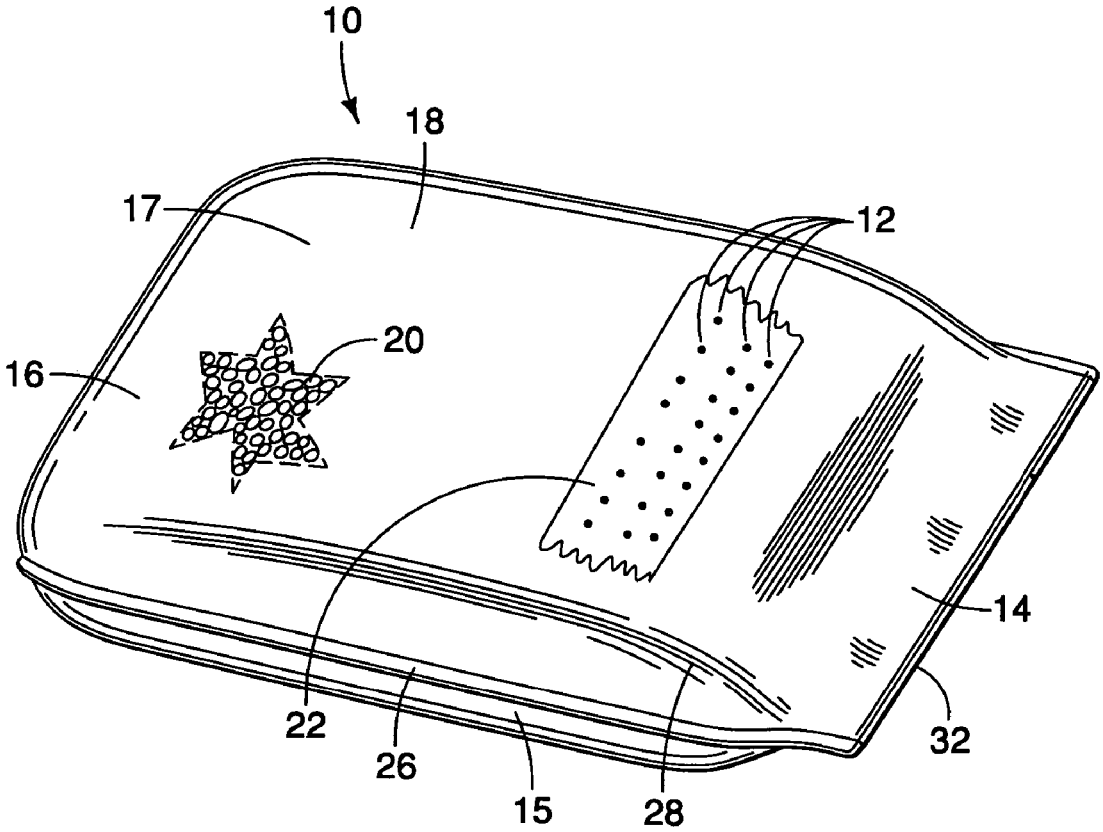
FIG. 1 is a top perspective view of the present bag.
Figure 2:
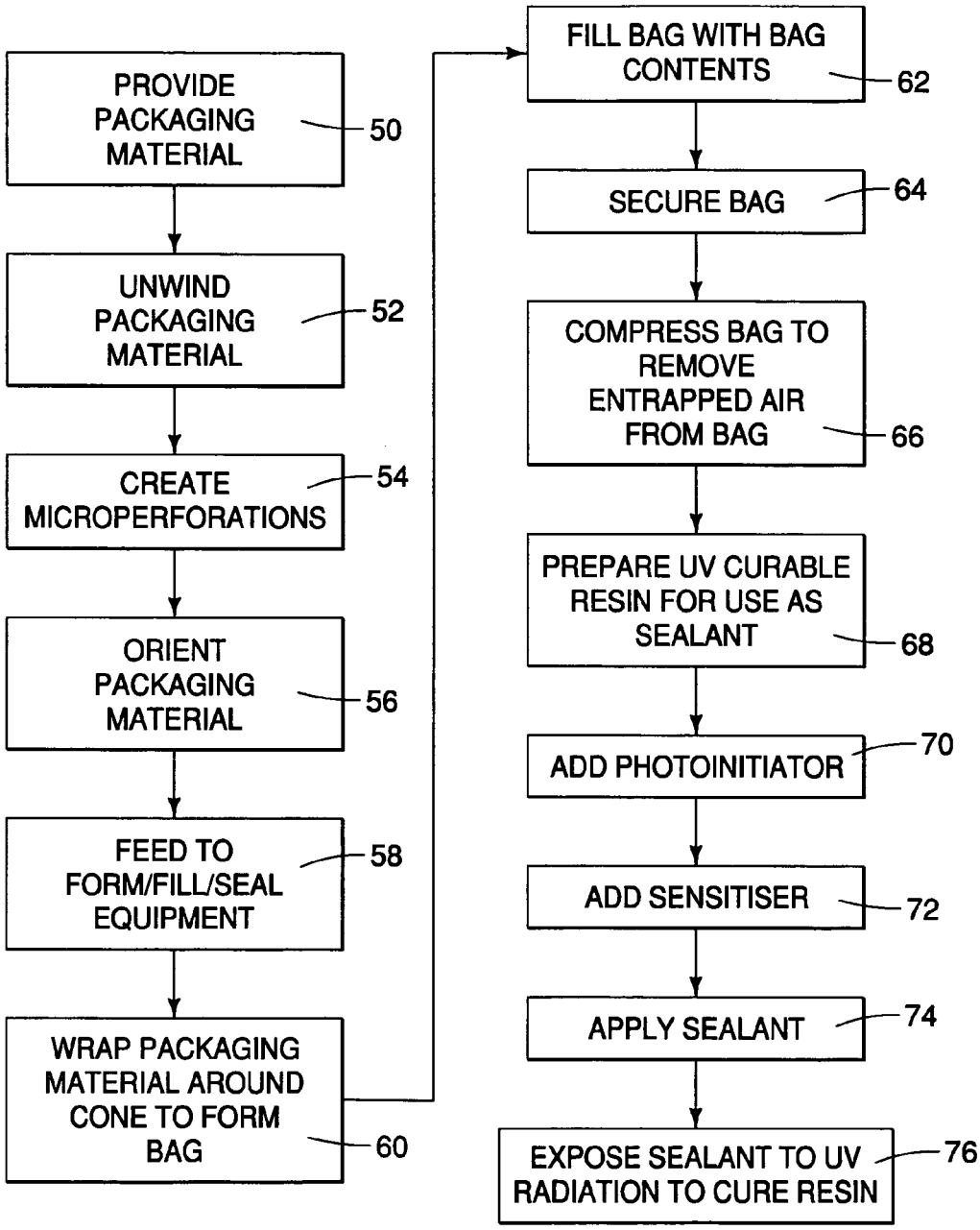
FIG. 2 is a flow diagram of the present bag-filling and sealing process.

Referring now to FIGS. 1 and 2, fine powders are packaged, shipped and stored in a bag, generally designated 10, containing microperforations 12. The bag 10 has at least a top 14, a pair of sides 15, a bottom 16 and at least one wall 17 having a surface 18 and positioned between the top and the bottom. Variations in bag construction are contemplated depending on the application and product to be packaged. Some bags may be suitable for use with the present process which do not necessarily include all of the listed components of the bag 10. The bag 10 is filled with bag contents 20. For the purposes of this discussion, the bag top 14 is defined as the portion of the bag 10 through which the bag contents 20 entered the bag prior to being sealed.

The bag 10 is made of a packaging material having sufficient strength to withstand without breaking the form/fill/seal process, being transported, stacked on shelves and moved to the place where the contents will be used. The packaging material, preferably a plastic film, is provided at 50, preferably on large rolls for use with high-speed equipment. Preferably, the packaging material is water-resistant to keep moisture from entering the bag after it is sealed. More preferably, the packaging material includes at least one plastic film. Preferred plastics include polyethylenes, polyolefins and any thermoplastic materials. Other suitable plastics include polypropylene, nylons, polyesters, polyvinylchlorides, TYVEK® material (E.I. de Pont de Nemours and Co., Wilmington, Del.), polyethylene teraphthlate, such as MYLAR® polyester film (E.I. de Pont de Nemours and Co., Wilmington, Del.) or any sealable plastic films.

The packaging material is optionally formed from one or more layers, including, but not limited to paper, plastic films or foils. The layers are preferably bonded to each other using any suitable method, including heat bonding or adhesives. One specific embodiment of a packaging material is a multiple ply plastic film. Preferred examples of the multiple ply packaging material include plastic coated paper and multi-ply plastic films having several layers of polyethylene or a layer of nylon sandwiched between two layers of polyethylene. The use of an inner polyethylene ply is preferred for obtaining a good seal.

After the packaging material is unwound at 52 from the roll and moved toward the form/fill/seal equipment, the microperforations 12 are created at 54 in the material. In the preferred embodiment, the microperforations 12 are created prior to forming the bag 10. The packing material, the fill rate, the sealant and the bag contents 20 determine the exact size and number of the microperforations 12. The finer the bag contents 20, the smaller the microperforations 12 should be to contain the contents. For example, powders having an average particle size of about 20 μm to about 30 μm are inhibited from escaping the bag by microperforations up to about 150 μm. If the bag contents 20 have a larger average particle size, proportionally larger microperforations 12 may be used.

The maximum size of the microperforations 12 is also controlled by a sealant 22 used to close the microperforations. When the sealant 22 is applied, it must be able to bridge the microperforations 12 and maintain its integrity until it hardens. As the microperforations 12 become larger, the sealant 22 film thins until, eventually, it breaks prior to hardening. For the preferred polyethylene resin, the maximum microperforation is about 160 μm. Other resins or sealants are likely to have a different maximum perforation size.

Minimum size of the microperforations 12 is determined, at least in part, by the fill rate of the packaging line (not shown). Smaller microperforations 12 release entrapped air at a slower rate. In a few seconds, the air can be forced from an 18-pound bag of gypsum-based joint compound having 2400 microperforations as small as 40 μm. However, below 40 μm, either the number of microperforations is increased or the time required to evacuate the entrapped air increases. Where the bag contents 20 include gypsum or calcined gypsum, microperforations 12 are preferably in the range of from about 50 μm to about 150 μm, and more preferably from about 70 μm to about 100 μm. As depicted in the drawings, the microperforations 12 are shown for purposes of disclosure, however, in use, at 150 μm or less, the microperforations 12 would likely not be visible to the naked eye. A dense group of microperforations 12 is observable as a change in the gloss of the wall surface 18 at certain angles.

Both the number and size of the microperforations 12 are independently or cooperatively variable to meet various criteria. As the size of the microperforations 12 changes, the number of microperforations preferably changes if it is desirable to maintain approximately the same surface area through which entrapped air is expelled from the bag 10. At constant size, the number of microperforations 12 is changeable as long as the air is being expelled quickly enough to match the target fill rate. Changing of the sealant 22 could necessitate a different microperforation size and number. About 1000 to about 3000 microperforations 12 are preferred for an 18-pound bag 10 where the bag contents 20 include gypsum-based joint compound. From the above considerations, one skilled in the art should be able to balance the sealant 22 properties, the bag contents 20, the fill rate and the packaging material to determine an appropriate size and number for the microperforations 12.

Preferably, the microperforations 12 are positioned on at least one portion of the bag. Although the microperforations 12 are effective when dispersed over the entire surface 18 of the bag 10, it is more expensive to purchase and more difficult to apply the sealant 22 to the whole bag, and thus is not preferred. The sealant 22 is also difficult to apply where microperforations 12 occur within folds (not shown), near seams 26 or on curved portions 28 of the bag 10. These areas are usable for microperforations 12, but are not preferred. If necessary, the sealant 22 is applicable in multiple steps to satisfactorily coat all surfaces of the bag 10. Thus, it is preferable to position the microperforations 12 on a single surface of the bag 10. More preferably, the microperforations 12 are positioned on a portion of the bag 10 that is easily accessible for application of the sealant 22 and that is relatively flat. As such, the walls 17 of the bag 10 are preferred locations for the microperforations 12.

The number and density of the microperforations 12 will determine the size of the portion of the bag surface 18 that is utilized for microperforations. Surface areas as small as one square inch are contemplated for coverage by the microperforations 12. Densities of about 10 to about 800 microperforations 12 per square inch are preferred for the 18-pound joint compound bag 10 described above, utilizing only 3-6 square inches for approximately 2400 perforations. The minimum preferred density is one that fits the microperforations 12 on one surface 18 of the bag 10, while the maximum density is one that does not unsatisfactorily compromise the strength of the bag in the vicinity of the microperforations. Preferably the microperforations 12 are regularly spaced, but not necessarily so.

All of the microperforations 12 need not be confined to a single portion of the bag 10. The microperforations 12 are configurable in any orientation, shape or combination of shapes desired. For example, the microperforations 12 could be configured to spell a tradename, corporate logo or both. Two or more portions are useful for the microperforations 12, for example, a portion on each of the walls 17 of the bag 10. Individual microperforations 12 are preferably substantially circular on the wall surface 18, however, no particular shape is required as long as the edges are smooth and the shape does not facilitate micropore clogging.

Preferably, the microperforations 12 are formed by a programmable laser (not shown), although any method can be used that produces microperforations 12 of the appropriate size having smooth edges. The preferred laser is an 80 watt, carbon dioxide laser that is controlled by computer. Preferably, the laser is programmable to make the microperforations 12 in the appropriate shape, size and density. Processes for laser scoring of substrates such as those described in U.S. Pat. Nos. 5,630,308 and 5,158,499, which are hereby incorporated by reference herein, are suitable for use with this invention. Suitable lasers are available from Parallax Technology, Inc. of Waltham, Mass.

At step 62, when the sides 15 and bottom 16 of the bag 10 are closed, the bag is filled with the bag contents 20 and air. Although the present bag 10 is particularly well suited for use with fine powders, it is useful for any product for which removal of the entrapped air is beneficial. For example, coffee is suitable as contents 20 for the bag 10, since it remains fresher when exposure to air is minimized. However, the most benefit is achieved when the bag 10 is used with contents 20 including cement, gypsum, cocoa, joint compounds, calcium carbonate, flour, lime, and the like. Any method of filling the bag 10 is suitable. If the bag 10 is formed around the cone in the forming step 60, then the same cone is optionally used to fill the bag at step 62, being withdrawn only after the bag is filled.

Where moisture is especially damaging to the bag contents 20, a moisture removing device or desiccant is optionally added to the bag 10. The desiccant is a moisture scavenger in any form, including a packet or a tablet. Silica gel is frequently used to remove moisture in packaging. The desiccant is suitably added to the bag 10 either before, concurrently with or after the bag contents 20.

Following filling, the top 14 of the bag 10 is closed and secured at step 64 by any known method including at least one of heat sealing, gluing, folding and fastening, closing in both the bag contents 20 and the retained air. Back pressure from the filling operation is likely, though not necessarily, to have introduced an excess amount of air into the bag 10. Immediately after closing, the bag 10 is likely to appear to be puffy, with one or more of walls 17 bulging outward.

When the bag 10 has been closed, the entrapped air is preferably actively expelled from the bag 10 at step 66 through the microperforations 12. At least a portion of the entrapped air is expelled that is sufficient to allow the bags to be stable and compact when stacked. Although some air leaves the bag without application of external force, it is preferable to expel the air quickly to maintain a fill rate comparable to that of paper bags.

Preferably the bag 10 is compressed at step 66, expelling at least a portion of the entrapped air, however, any method of encouraging the air to exit the bag through the microperforations 12 is useful. Vibration of the bag 10, such as on a vibrating conveyor, collects the entrapped air at the highest portion of the bag 10, and if oriented so that the microperforations 12 are at this position, at least some of the air will escape through the microperforations. Preferred equipment (not shown) for removing the entrapped air include a vibrating conveyor, a bag flattening conveyor, a piston driven plate, pinch rollers, or any other suitable device. The bag flattening conveyor, pinch rollers and piston driven plate all apply pressure to the surface 18 of the bag 10, pushing it inward toward a center of the bag. When the pressure is applied, the entrapped air is pushed from the bag through the microperforations 12.

The air removing equipment, the bag 10 and the microperforations 12 are preferably designed and positioned so that the equipment does not hinder the escape of air through the microperforations. If, for example, a piston driven plate is used at 66 to squeeze the entrapped air from the bag 10, the portion of the plate directly over the perforations 12 optionally includes one or more cutouts to allow the air to escape.

If desired, a dust collection system (not shown) is applicable to the air removal device to prevent product dust from escaping to the environment. Expelled air is optionally removed from the environment for cleaning by a vacuum. Powder fines that escaped with the entrapped air are removable by any cleaning suitable technology means, including, but not limited to a filter or electrostatic precipitation.

Following removal of a portion of the entrapped air at 66, the sealant 22 is provided at 68 and the microperforations 12 are sealed at 74 to prevent air and moisture from the environment from reentering the bag 10. Any sealant 22 is optionally provided at step 68 to close the microperforations 12, including, but limited to resins and adhesives. Hot melt adhesives are useful sealants 22 with certain types of packaging materials. The use of natural or synthetic resins is contemplated, including water-based resins, solvent-based resins and resins that cure under exposure to certain frequencies, such as UV light. The sealant 22 must have sufficient adhesion with the packaging material and film strength to bridge a gap defined by the microperforation 12 and maintain film integrity until it hardens, sealing the microperforation.

Many of the sealants 22 are customizable to create different finishes as desired. The resin 22 can be made to match the color and/or texture of the bag 10 so that it will blend into the bag 10. If a different design is preferred, the resin 22 is colorable to coordinating or contrasting colors to create banners or patterns as desired. Thus, the resin 22 can become part of the trade dress of the product 20, contributing as desired to the overall appearance of the bag 10.

Quick curing resins 22 are especially suited for use in sealing the microperforations 12, especially resins that are cured by exposure to light. These resins 22 are easily applied by brush and harden extremely slowly until exposed to a particular light frequency. More preferred are UV-curable resins that harden when exposed to UV wavelengths. The UV light initiates polymerization reactions which cross-link the oligomers to form a strong, hard surface. Examples of UV-curable resins include polyurethanes, acrylics, urethane acrylics, epoxies and blends thereof. A preferred UV-curable resin is Apsqure 3010-92 marketed by Applied Polymer Systems, Inc. of Schaumburg, Ill. This resin includes from about 40 to about 60 wt % acrylated acrylic (UCB Surface Specialists, Smyrna, Ga.), from about 20 to about 40 wt % isoborneal acrylate (UCB Surface Specialists, Smyrna, Ga.), about 10% to about 20% ethyloxylated trimethylol propane triacrylate (UCB Surface Specialists, Smyrna, Ga.) and about 5 to about 10 wt % of a photoinitiator package.

When choosing a sealant 22, many factors are taken into consideration. The preferred sealant 22 is compatible with the packaging material, sealing the microperforations 12 without substantially melting or dissolving portions of the bag 10. If it is desirable for the sealant 22 to blend with the appearance the packaging material, other characteristics of the preferred sealant are that it has a similar surface texture and flexibility as the packaging material, and that it dries with few bubbles or surface imperfections. Preferably, the sealant 22 has sufficient adhesion to the packaging material that it does not flake or peal off after drying. Since it is difficult to keep the surface of the bag powder-free in this environment, it is also preferred that the adhesion between the sealant and the bag not be impeded by the presence of powder on the surface of the bag during sealing. Also, because bags 10 of some products 20, such as gypsum or cement, are stored in a wide variety of conditions, the sealant should maintain the properties listed above over a temperature range of about 32° F. to about 110° F.

If the bag contents 20 are sensitive to exposure to water or moisture, it is preferred that the sealant 22 be water-resistant to inhibit moisture from entering the bag 10 over time through the microperforations 12. One test used for a preferred water-resistant sealant 22 is that it is able to withstand a direct spray of water from a common utility sink for 30 seconds without compromising the contents 20 of the bag 10.

Prior to use as a sealant 22, many resins are combined with an optional photoinitiator at step 70. Upon exposure to particular frequencies of light, the photoinitiator breaks down into free radicals that initiate polymerization of the resin to form a strong, hard plastic film. Any photoinitiator is useful in this invention that initiates polymerization in the selected resin 22 and which is compatible with the packaging material. Preferred photoinitiators include acetophenones, benzophenones and mixtures thereof. The preferred resin includes from about 5 to about 10% of a photoinitiator package available from Aldrich Chemical of Milwaukee, Wis. The package includes a combination of acetophenone and benzophenone as the photoinitiator and a trace amount of an optical brightener. Some curable resins 22, such as Flexcure Resins by Ashland Specialty Chemical, Dublin, Ohio, need no photoinitiator.

Some photoinitiators or resins 22 turn yellow over time. If it is important that the color remain true, the resin and photoinitiator should be selected with this goal in mind. The addition of an optional UV absorber or optical brightener also minimizes yellowing caused by by-products of excessive UV exposure.

Another optional component of the resin 22 is a sensitiser, which is added at step 72. Many photoinitiators can form free radicals in ways other than exposure to light. The sensitiser absorbs energy at different wavelengths than the photoinitiator, then transfers the energy to the photoinitiator, effectively shifting the absorption spectrum of the photoinitiator. The sensitiser is useful for improving the cure speed and efficiency in some circumstances. Optionally, steps 70 and 72 occur prior to step 68 where the UV-curable resin 22 is provided where the photoinitiator and the sensitiser have been previously added by the manufacturer.

After the resin 22 has been prepared at steps 68, 70 and 72, and is ready for use, it is applied at 74 to the portion or portions of the bag 10 containing microperforations 12. Any method of application may be used, including, but not limited to brushing, rolling, coating, spraying, stamping or screeding. Because the resin 22 will seal around individual particles that remain on the bag surface 18, it is not necessary that the bag 10 be cleaned prior to resin 22 application. However, a sufficient portion of the bag 10 must be available for adhesion of the resin 22.

Once applied to the bag 10 at 74, the resin 22 is hardened to form seals over the microperforations 12 at step 76. Some sealants simply air dry to a hard surface. When exposed to a UV radiation source (not shown) at step 76, the resin 22 and the photoinitiator react in seconds to harden and seal the microperforations 12. The UV-curable resin is preferably exposed to the UV source for a sufficient time to form a permanent seal over the microperforations 12. The exact reaction time will depend on radiation source, the distance between the source and the bag 10, the exact resin 22 and photoinitiator that are used. A Model F300S bulb from Fusion UV Systems, Inc., Gaithersburg, Md., is a preferred radiation source. Typically, when exposed to a 300-watt, focused lighting system, reaction times of 3-4 seconds are achieved. When the resin 22 is applied to areas such as creases in the bag 10, incomplete curing due to insufficient exposure to the light may be experienced. The UV source should therefore be positioned so that all resin-coated areas are cured to the desired hardness. The use of additional UV sources or a higher wattage source can also be used to properly cure all of the resin 22. Lower wattage sources are also usable but require extended curing times. When the resin 22 is properly applied and cured, the microperforations 12 are sealed to keep air and moisture from entering the bag 10.

In the following examples, plastic bags were manufactured to test as replacement packaging for 18-pound (8.7 Kg) bags of Easy Sand setting-type joint compound (USG Corporation, Chicago, Ill.). Microperforations were formed in the packaging material by laser prior to formation of the bags, then the bags were formed by heat sealing a wall seam to form a tube, then one end to form the bottom of the bag. The bags were filled with the joint compound powder. The top of the bag was then heat sealed to close it. The entrapped air within the bag was removed through a combination of vibration and pinch rollers, forcing the entrapped air out through the microperforations. After removing the air, a sealant was applied to the microperforations by brush and allowed to harden.

During testing, the bags were stored at various temperatures and humidities to simulate a variety of storage conditions. Where the bags were cycled between extremes of hot and cold, the bags were transferred once a day to the opposing condition except on weekends. When the temperature/humidity testing was complete, the entire contents of the bag were removed and sifted through a 12-mesh screen, then weighing the retained lumps.

EXAMPLE 1

Plastic bags made of 3 ply polyethylene (Plassein International Packaging, Willington, Conn.) were prepared having 125 μm microperforations along the length of each side of the bag. The microperforations were tightly packed within a thin band running along the sides of the package. The bags were filled with 2.5 (5.7 Kg) pounds of the joint compound mix and sealed, the entrapped air expelled, then heat sealed at the top closure to close the bag. A GLUEFAST ethyl acrylate/2-ethylhexyl acrylate copolymer sealant (Hughes Enterprises, Trenton, N.J.) was applied via brush and allowed to air dry.

Aging tests were conducted to determine if application of a sealant was beneficial over time. Test bags were either held at constant temperature and humidity or cycled between various temperature and humidity conditions for a period of eleven days. The following test conditions were used:

Test Condition 1: 90° F. (32° C.) and 90% Relative Humidity, Continuous.

Test Condition 2: Cycle between 90° F. (32° C.)—90% Relative Humidity and 40° F. and 80% Relative Humidity.

Test Condition 3: Cycle between 90° F. (32° C.)—90% Relative Humidity and a refrigerator freezer set at −6° F. (−23° C.).

Results of the testing are reported in Table I.

TABLE I

| Test Condition | Paper Bag | Plastic Bag "A" | Plastic Bag "B" |
|---|---|---|---|
| Microperforations | None | 125 μm | 125 μm |
| Sealant | None | GLUEFAST Ethylacrylate/2-ethylhexyl acrylate copolymer | None |
| Gram Weight Lumps at Test Condition 1 | | 0.80 | 0.63 |
| Gram Weight Lumps at Test Condition 2 | 5 | 1.75 | 0.86 |
| Gram Weight Lumps at Test Condition 3 | 55 | 5.65 | 24.54 |

Application of the sealant to Plastic Bag Type "A" reduced lumping during cycling between extremes of heat and humidity compared to both the paper bag and the microperforated bag with no sealant.

EXAMPLE 2

Polyethylene bags of the type and source used in Example 1 were obtained for testing. Approximately 2400 microperforations were made in a 1"×4" (2.5 cm×10 cm) strip across the front of the bag. Each of the microperforations was about 100 μm.

The 18-pound bags were filled with Easy Sand Joint Compound mix and heat-sealed at the top. The sealant, Apsqure 9010-20 UV-curable resin (Applied Polymer Systems, Schaumburg, Ill.) was applied by brush. The perforated area was not cleaned prior to application to remove all of the joint compound dust from the front surface of the bag. While moving at 42 ft/min. (0.2 m/sec), the bags passed about 6 inches (15 cm) from a 300 Watt/in$^2$ (46 Watt/cm$^2$) UV Source described below.

The following tests demonstrate the effectiveness of ultraviolet curable resin on sealing the microperforations of a plastic bag containing Easy Sand setting-type joint compound.

TABLE 2

| Sample ID | Sample No. | Bulb Lamp Type | UV Photoinhibitor | Number of Passes |
|---|---|---|---|---|
| T42HX1-1 | 1 | H | XPI | 1 |
| T42HX1-2 | 2 | H | XPI | 1 |
| T42HC1-1 | 3 | H | CON | 1 |
| T42DC2-1 | 4 | D | CON | 2 |
| T42DC2-2 | 5 | D | CON | 2 |
| T42DC2-3 | 6 | D | CON | 2 |
| T42DC1-1 | 7 | D | CON | 1 |
| T42DC1-2 | 8 | D | CON | 1 |
| T42DC1-3 | 9 | D | CON | 1 |
| T42DX1-1 | 10 | D | XPI | 1 |
| T42DX1-2 | 11 | D | XPI | 1 |

Two different UV lamp types were tested, H and D spectra lamps. The H spectra lamp is designed for clear solutions, while the D spectra lamp is used more for thicker, opaque solutions. In the Column labeled "UV Photoinhibitor" samples using the normal or control (CON) concentration of inhibitor were differentiated from those having an extra amount (XPI) of photoinhibitor. Samples 4, 5 and 6 were passed by the UV lamp twice to assure that the resin was fully cured and to determine the effects of high UV exposure. Extra photoinhibitor was added to the samples.

In addition to Test Conditions 1, 2 and 3 described in Example 1, some of the above samples were tested under additional conditions described below.

Test Condition 4: 40° F. (5° C.)—80% Relative Humidity, Continuous.

Test Condition 5: 75° F. (24° C.)—30% Relative Humidity, Continuous.

Test Condition 6: Full Water Submersion.

Test Condition 7: Cycle between 40° F. (5° C.)—80% Relative Humidity and 30° F. (0° C.)—0% Relative Humidity.

The samples described above were tested at the conditions listed in the table below.

TABLE III

| Sample | Test Condition | Lump Weight | Resin Discoloration | Powder Leaks | Water Spray | Resin Cracking |
|---|---|---|---|---|---|---|
| 1 | 5 | N/A | None | None | Pass | None |
| 2 | 5 | N/A | None | None | Pass | None |
| 3 | 6 | N/A | Trace | N/A | N/A | None |
| 4 | 1 | 0.6 | Trace | None | N/A | None |
| 5 | 3 | 1.2 | Trace | Trace | N/A | Trace |
| 6 | 5 | 1.8 | Trace | Trace | N/A | None |
| 7 | 6 | N/A | None | N/A | N/A | |
| 8 | 4 | 1.7 | Slight | None | N/A | None |
| 9 | 7 | 1.0 | Slight | None | N/A | Trace |
| 10 | 5 | 1.5 | Trace | None | N/A | None |
| 11 | 5 | N/A | None | None | Pass | None |

These tests show that sealing of the microperforations effectively reduced lumping and kept moisture from the bags under a variety of conditions. Sample 7 was fully submerged in water by placing the bag in a 30-gallon (111 liters) tote filled with water to test the water-tightness of the seal. The bag was removed from the water when bubbles evidenced leakage from the bag. When the bag was opened, the joint compound at both ends of the bag was hydrated, however, the powder under the microperforations was dry and lump-free. This indicated that the leakage was occurring from the heat seals at either end of the bag, and not through the microperforations. The two bags exhibiting powder leaks, Samples 5 and 6, were also traced to the corners of the bag and did not result from failure of the microperforation seals.

The two bags that were aged by cycling them between extremes of high and low temperature and humidity exhibited hairline cracking of the UV resin resembling spider webs. Although the cracking was unsightly, it did not appear to effect the adhesion of the resin to the bag surface or result in any powder leaks.

While particular embodiments of the present invention have been shown and described, it will be appreciated by those skilled in the art that changes and modifications may be made thereto without departing from the invention in its broader aspects and as set forth in the following claims.

What is claimed is:

1. A method of making and filling a plastic bag comprising:

providing at least one plastic film;

creating a plurality of laser microperforations in the film;

forming a bag from the film including at least one wall and a bottom;

filling the bag with bag contents, including air and a fine powder having an average particle diameter of up to about 150 μm;

securing the bag;

removing at least a portion of the entrapped air in the bag through the microperforations; and sealing the microperforations solely with a film-forming UV curable resin selected to have sufficient film strength to cover the microperforations and maintain film integrity until it hardens.

2. The method of claim 1 wherein said sealing step comprises applying a sealant to the microperforations.

3. The method of claim 2 further comprising a curing step comprising exposing the sealant to UV radiation after application.

4. The method of claim 1 wherein said creating step comprises heating the packaging material in a localized area to form the microperforations.

5. A method of making and filling a plastic bag comprising:

providing a laser microperforated bag;

filling the bag with a fine powder having an average particle size of up to about 150 μm;

removing at least a portion of entrapped air in the bag through the bag's microperforations;

selecting a UV curable sealant to have sufficient film strength to cover the microperforations and to maintain film integrity until the sealant hardens;

applying the UV curable sealant to the microperforations; and exposing the sealant to UV radiation, wherein said sealant is a sole covering over said microperforations.

6. The method of claim 5 wherein said applying step further comprises preparing the UV curable sealant prior to applying it.

7. The method of claim 6 wherein said preparing step comprises adding an appropriate amount of a photoinitiator to the sealant.

8. The method of claim 6 wherein said preparing step comprises adding an appropriate amount of a sensitiser to the sealant.

9. The method of claim 5 wherein said removing step comprises compressing the bag and expelling entrapped air through the microperforations.

10. A packaged product, comprising:

a bag comprising a bottom, at least one side, a top, and a plurality of laser microperforations, said top and bottom being secured;

bag contents inside said bag comprising a fine powder having an average particle size of up to about 150 μm, and an amount of air less than that present in the bag when said top and said bottom were secured; and a UV-cured sealant configured for sealing said microperforations, wherein said sealant is the sole covering over said microperforations.

11. The product of claim 10 wherein said packaging material comprises a plastic film.

12. The product of claim 11 wherein said plastic comprises polyethylene.

13. The product of claim 10 wherein said fine powder has an average particle size of up to about 150 μm and comprises at least one of cement, gypsum and joint compound mix.

14. The product of claim 10 wherein said sealant is a UV-curable resin.

15. The product of claim 14 further comprising a photoinitiator.

16. The product of claim 10 wherein said microperforations are formed by a laser and are sized from about 50 μm to about 150 μm.

17. The product of claim 10 wherein said microperforations are sized from about 60 μm to about 100 μm.

18. A packaged powdered product, comprising a laser microperforated bag comprising a top and a bottom;

bag contents inside said bag comprising a fine powder product with an average particle diameter of up to about 150 μm and an amount of air less than that present in the bag when said top and said bottom were secured, at least a portion of said air having been expelled through said microperforations; and a UV-cured sealant over said microperforations and configured to seal them, wherein said UV-cured sealant further comprises a photoinitiator.

* * * * *